US005449261A

United States Patent [19]

Rossato

[11] Patent Number: 5,449,261

[45] Date of Patent: Sep. 12, 1995

[54] MOTOR VEHICLE PARKING INSTALLATION

[76] Inventor: Eride Rossato, Via Galilei 20, 30035 - Mirano, Italy

[21] Appl. No.: 204,371

[22] PCT Filed: Sep. 14, 1992

[86] PCT No.: PCT/EP92/02104

§ 371 Date: Mar. 11, 1994

§ 102(e) Date: Mar. 11, 1994

[87] PCT Pub. No.: WO93/06322

PCT Pub. Date: Apr. 1, 1993

[30] Foreign Application Priority Data

Sep. 20, 1991 [IT] Italy ..... VE91A0047

[51] Int. Cl.[6] ..... E04H 6/12

[52] U.S. Cl. ..... 414/240; 414/234; 414/239; 414/264; 187/221

[58] Field of Search ..... 187/8.41, 8.45, 8.61, 187/8.62, 8.64, 8.65, 8.67, 8.77, 26; 414/233, 234, 239, 240, 264

[56] References Cited

U.S. PATENT DOCUMENTS

| | | | |
|---|---|---|---|
| 2,726,774 | 12/1955 | Newsome et al. | 414/264 X |
| 2,890,802 | 6/1959 | Alimanestiano | 414/264 X |
| 4,337,013 | 6/1982 | Buttironi | 414/240 |
| 5,018,926 | 5/1991 | Sternad | 414/239 X |
| 5,238,348 | 8/1993 | Reimer | 414/264 X |

*Primary Examiner*—Robert P. Olszewski

*Assistant Examiner*—Dean A. Reichard

*Attorney, Agent, or Firm*—Hoffman, Wasson & Gitler

[57] ABSTRACT

A reliable motor vehicle parking installation having an economical construction is provided and includes an extremely flexible structure to maximize the available space. Its construction can extend above and/or below the ground. The installation includes a load-bearing structure having at least one tower with multiple cells arranged in superimposed horizontal rows. Each cell has at least one pair of longitudinal horizontal guide members disposed perpendicular to the horizontal rows of cells. A platform moves along a vertical structure, which is itself movable horizontally, parallel to the horizontal rows of cells. The platform has at least one pair of longitudinal members arranged in the same member as the longitudinal member of each cell. Multiple trays are provided each of which includes a pair of vehicle parking runways, and an actuator moves the trays between the platform and the cells of each tower. Each actuator has a double-acting hydraulic cylinder piston unit with an axis parallel to the longitudinal guide members so that a first element of the cylinder piston unit is rigid with the platform and a second element moves relative to the first one stretching towards the cells. The hydraulic cylinder piston unit can be connected to each tray by a device consisting of a member integral with the movable part of a cylinder piston unit and activated only in its utmost elongated position. Each tray can be releasably connected to the corresponding cell.

25 Claims, 8 Drawing Sheets

MOTOR VEHICLE PARKING INSTALLATION

FIELD OF THE INVENTION

This invention relates to a motor vehicle parking installation.

DESCRIPTION OF THE PRIOR ART

Motor vehicle parking installations are known comprising a load-bearing structure divided into units or "cells" of suitable dimensions for containing a motor vehicle, and a transfer device movable relative to said structure in order to convey motor vehicle from an entry position to any of these cells and vice versa in the sense of taking it from any one of these on termination of the parking period and moving it to an exit position. This exit position can coincide with or be different from the entry position.

Installations of this type have already been developed in the most varied forms using the most varied operating principles for solving the individual technical problems which arise, and which generally relate to the configuration of the available space, its development above and/or below the ground, the handling system etc. Some of these installations are described for example in EP-A1-0 214 048, FR-A-1 450 015, DE-A1-2 058 404, EP-A2-0 152 789, EP-A1-0 041 241, EP-A2-0 220 594, EP-A1-0 351 374, EP-A2-0 143 139, EP-A1-0 275 004, WO 86/03246, WO 86/04107, WO 88/08476, WO 89/01557 and WO 90/10132, and differ from each other by their structural form, their vehicle handling system, their control and safety systems, the parking management criteria and a large variety of details relating to one or other of the specific technical problems which have to be confronted in any particular case.

DE-B-1.684.789 relates to a storage system for motor vehicles or other goods, in which support platforms are provided on a plurality of storeys, and an elevator is provided for conveying the support platforms to and from the storeys, the elevator being provided with drive means for moving the support platforms from the elevator to the storeys and vice versa.

FR-A-1.450.015 describes a parking installation comprising a plurality of superimposed cells placed on both the sides of a central passage orthogonal to the direction of introduction of the vehicle into the cells.

The main object of the present invention is to provide a motor vehicle parking installation which combines simple and economical construction with very high operational reliability.

A further object of the invention is to provide a parking installation the structure of which is extremely flexible on the basis of the available space, in that with regard to its configuration it can extend above and/or below the ground, with regard to its vehicle arrangement these can be side by side or aligned, and with regard to its entry and exit positions these can either coincide or be separate and can be situated in any position relative to the structure in accordance with the relationship between .the communication paths of the installation and the external roadways..

These and further objects which will be apparent from the ensuing description are attained according to the invention by a motor vehicle parking installation.

BRIEF DESCRIPTION OF THE DRAWINGS

A preferred embodiment of the present invention is described hereinafter with reference to the accompanying drawings, in which.

DESCRIPTION OF PREFERRED EMBODIMENTS

Figure 1:
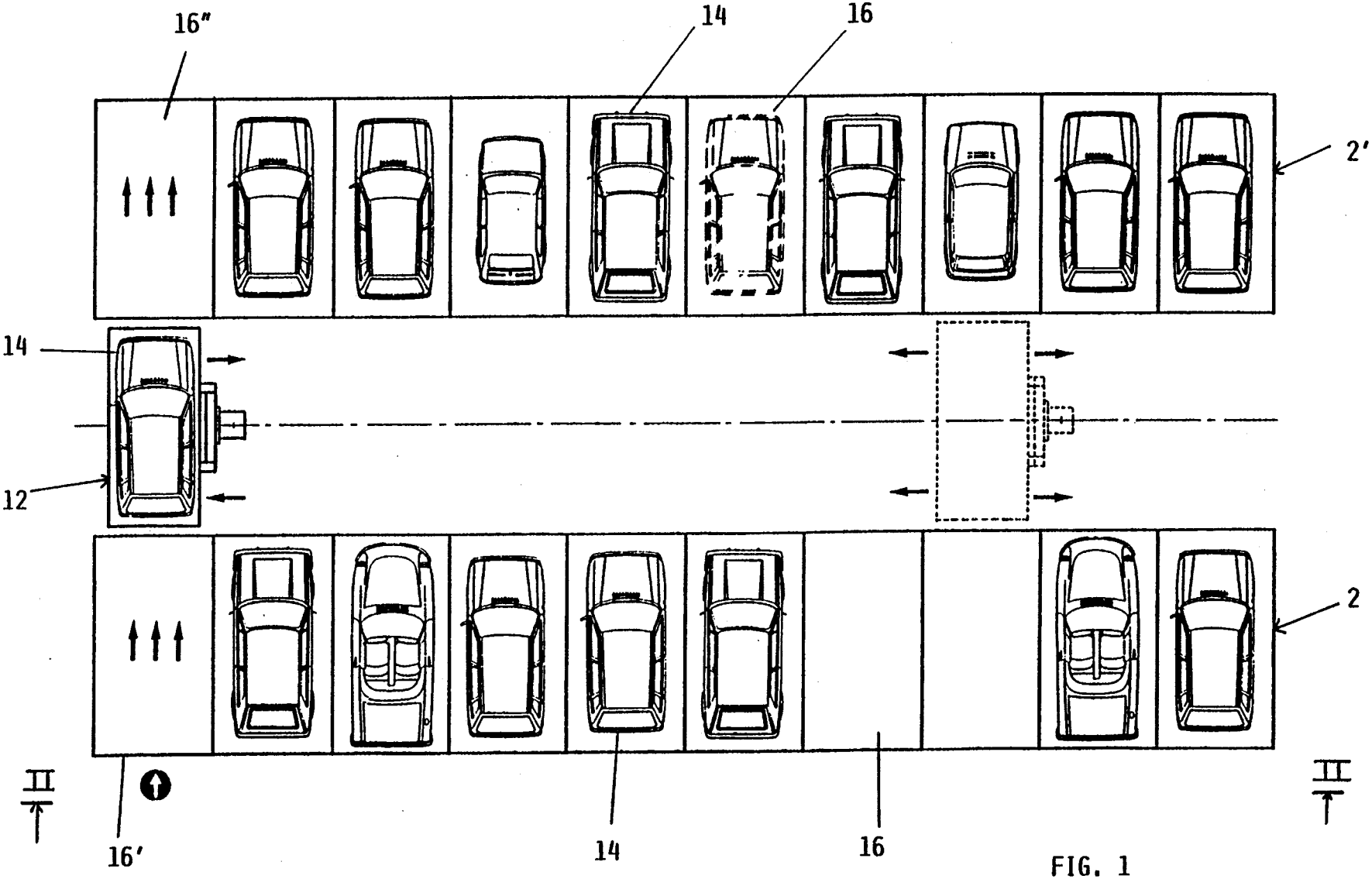
FIG. 1 is a schematic plan view of a first embodiment of an installation according to the invention.
Figure 2:
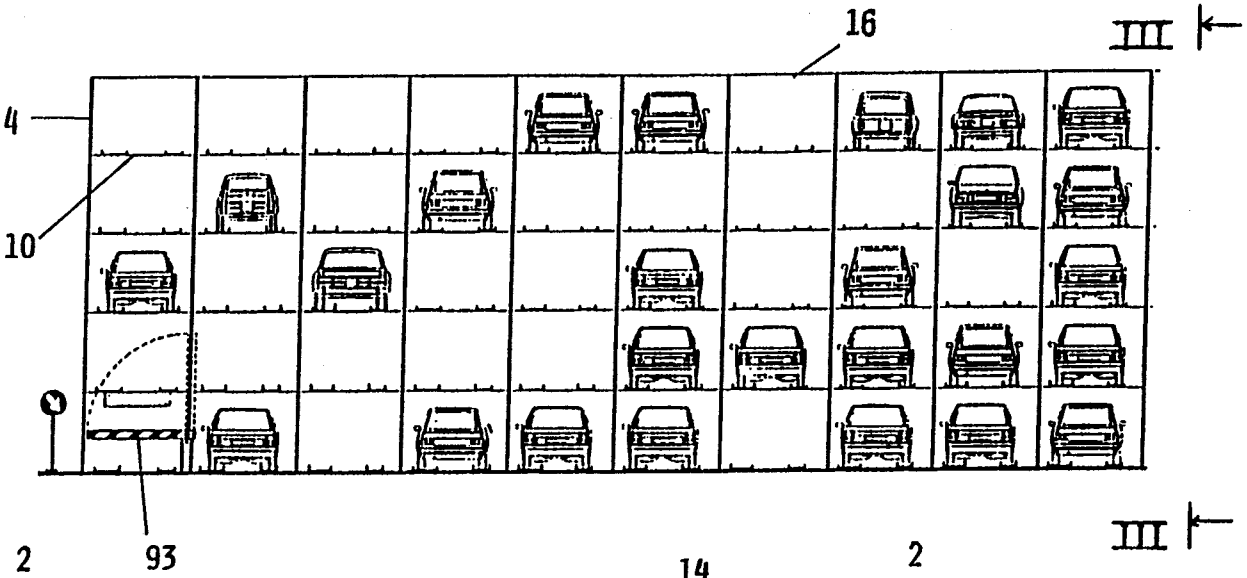
FIG. 2 is a front view thereof on the line II—II of FIG. 1.
Figure 3:
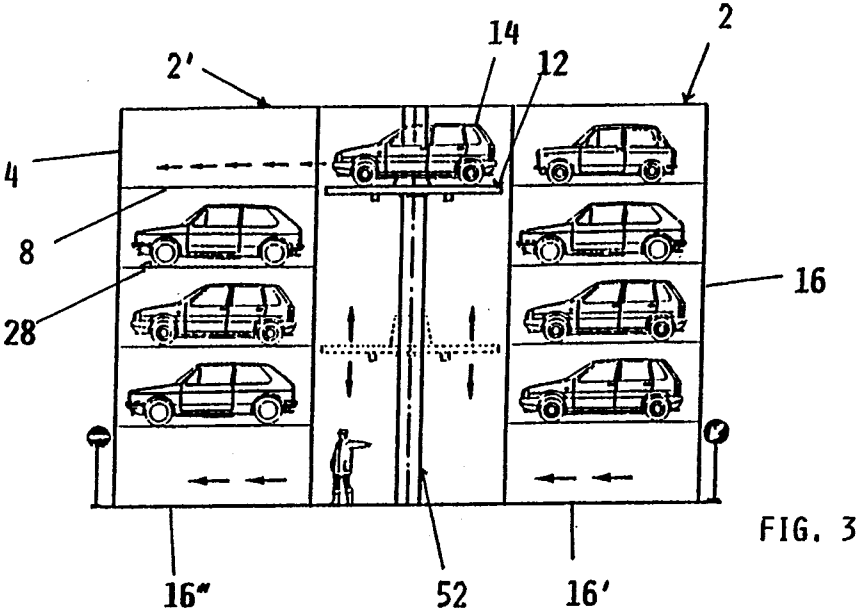
FIG. 3 is a side view thereof on the line III—III of FIG. 2.
Figure 4:
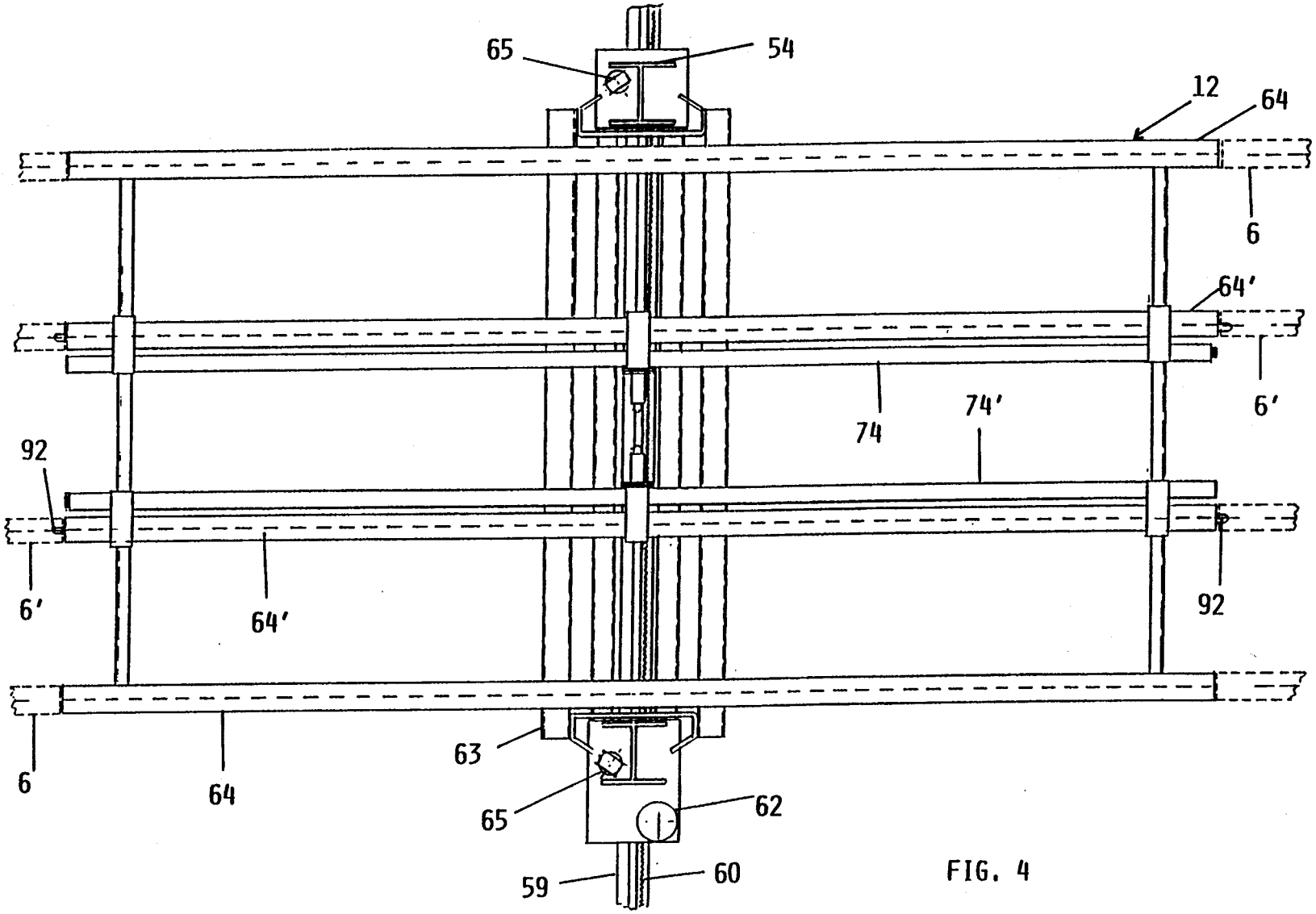
FIG. 4 is a detailed plan view of the movable platform and its vertical structure.
Figure 6:
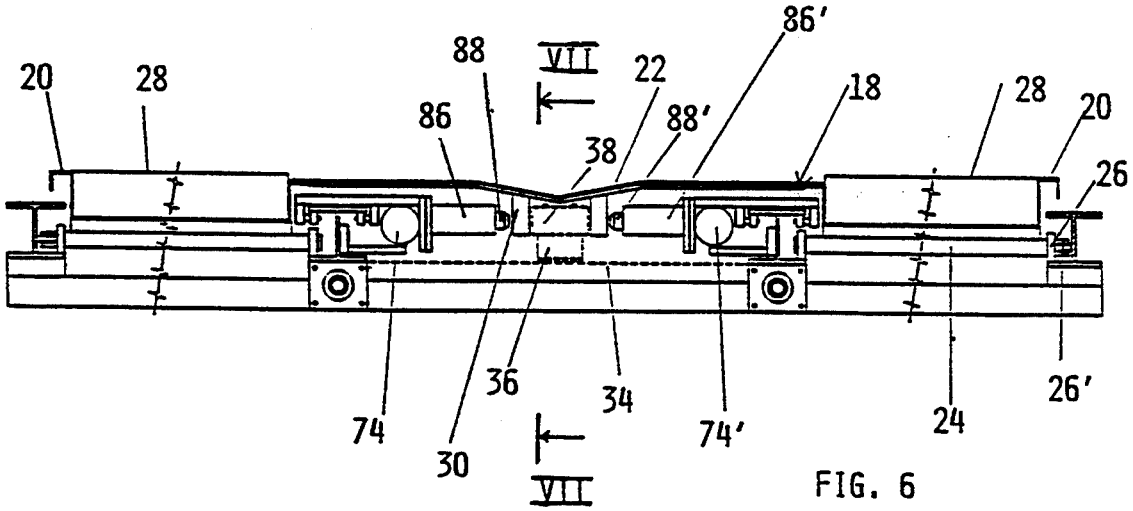
FIG. 6 is a cross-section through the movable platform, on which a tray is mounted.
Figure 5:
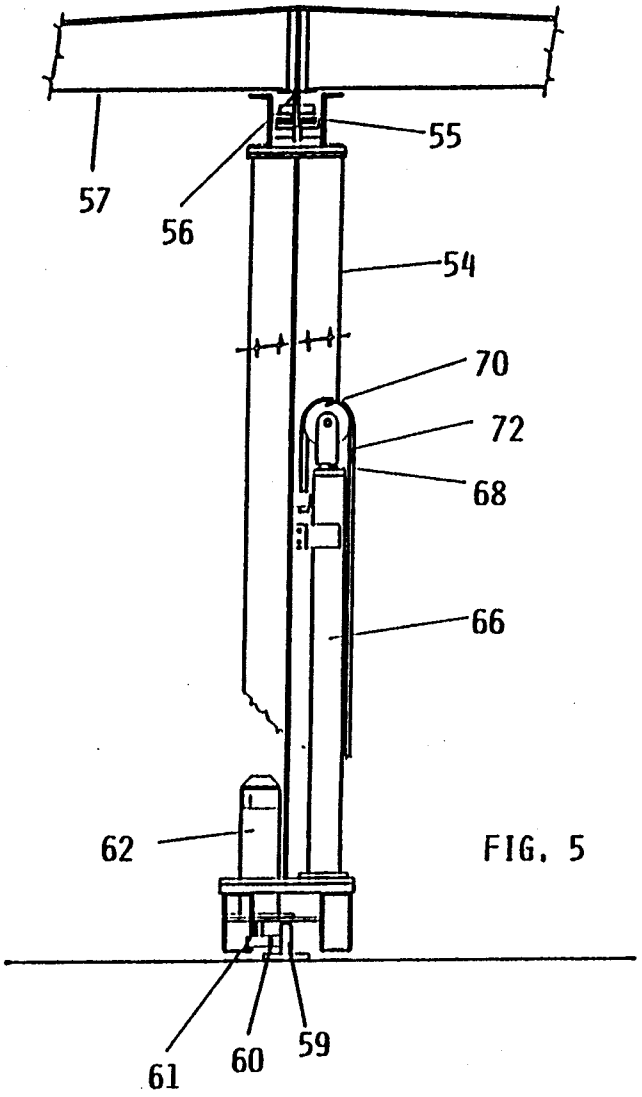
FIG. 5 is a partial side view of said vertical structure.
Figure 7:
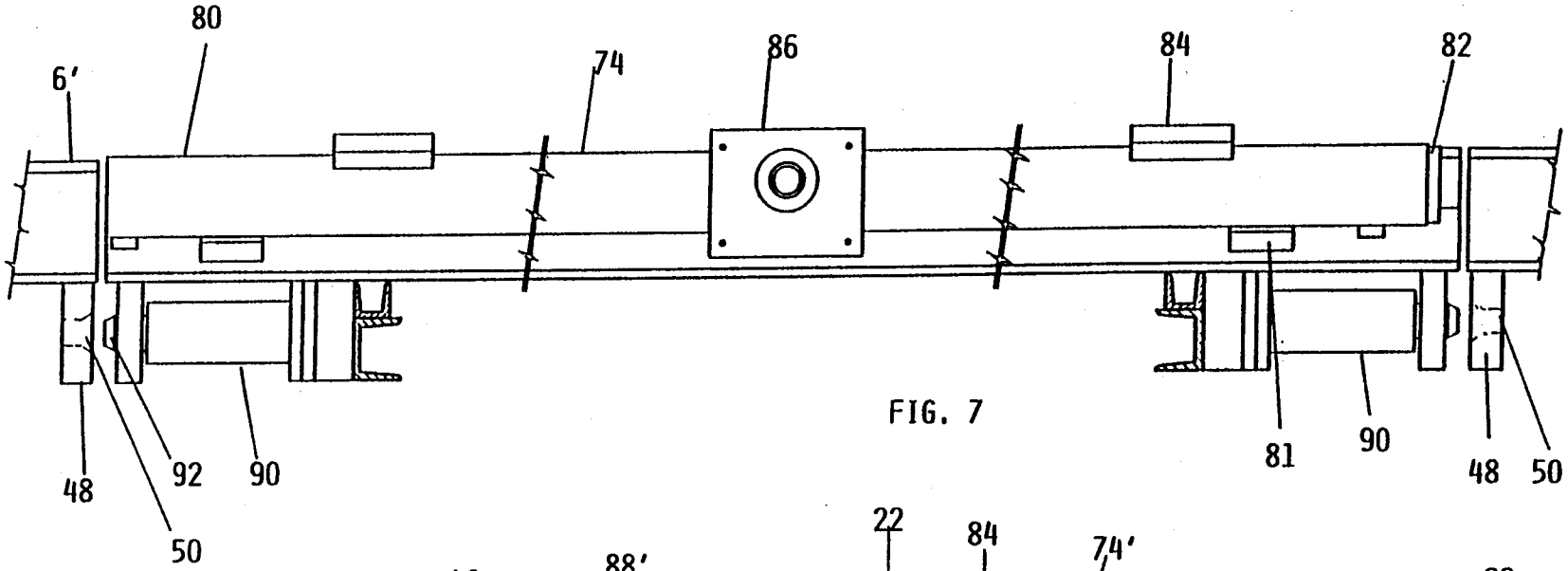
FIG. 7 is an enlarged partial vertical section through the platform on the line VII—VII of FIG. 6.
Figure 8:
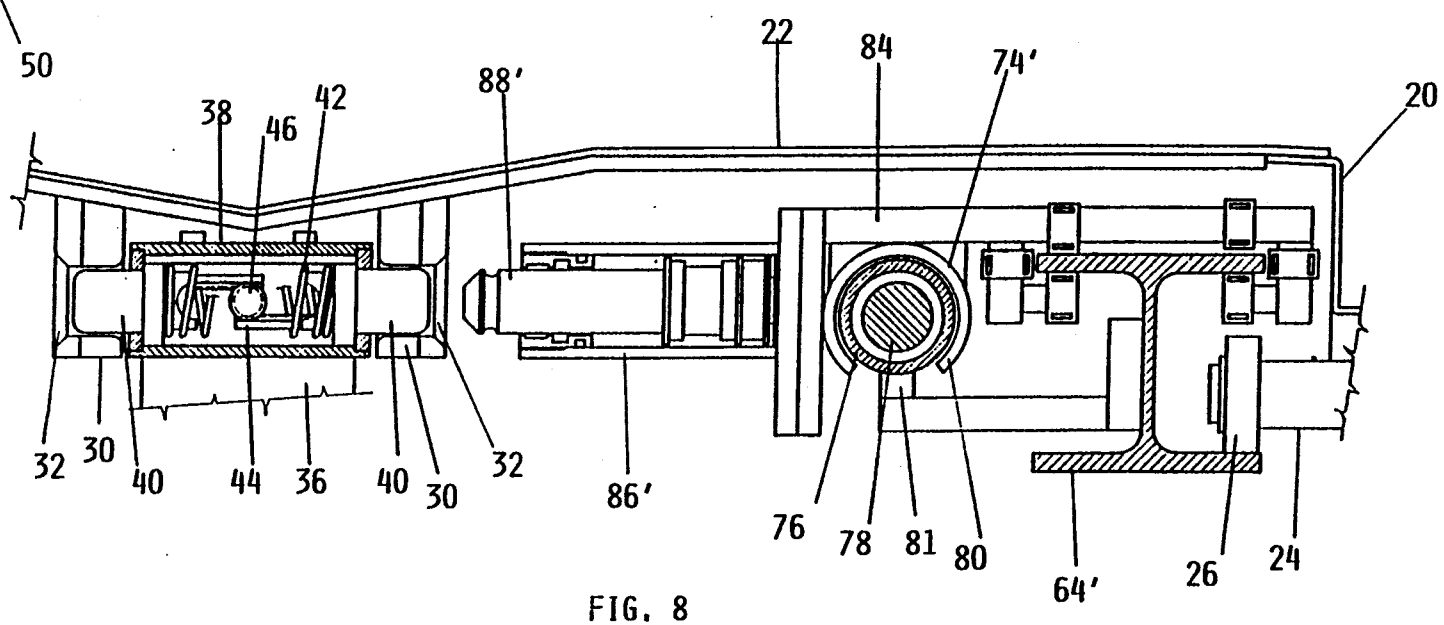
FIG. 8 is a schematic partly sectional detailed enlarged view, taken in the same view as FIG. 6, of a longitudinal actuator mounted on the tray transporting platform, and of the member for connecting a tray to a cell.

As can be seen from the figures, the installation according to the invention comprises a load-bearing structure, preferably constructed of steel sections constituting the uprights 4, the longitudinal members 8, the cross-members 10 and possible bracing, and sized to withstand the maximum predicted stress. These sections are suitably joined together by bolting or welding.

For semplicity, a detailed description will be given of one particular configuration of this structure, comprising two equal towers indicated overall by 2, 2' which face each other and are spaced apart by a distance suitable to enable a platform 12 for transporting a motor vehicle 14 to pass between them. The two towers are of parallelepiped shape with the various structural section arranged to define several horizontal superposed rows of cells 16, each of which is provided for housing a vehicle 14 side by side with the vehicles housed in the other cells.

In the embodiment described in detail, the entry position 16' is provided at an end cell of the lower row of one tower 2, and the exit position 16'' is provided at the facing end cell of the lower row of the other tower 2'.

The two base cross-members 10 of each cell 16, 16', 16'' support four longitudinal guide members, two external 6 and two internal 6', which are parallel to the longitudinal members 8 of the load-bearing structure. The purpose of the longitudinal members 6, 6' is to support and guide a tray 18 for supporting and containing a motor vehicle 14. The tray 18 comprises two runways 20 and a plate 22 connecting them together.

Each runway 20 is formed from an essentially C-shaped metal plate section open upwards, and is supported by a plurality of small cross-members 24 welded to the lower surface of the runway and provided at their ends with bearings 26 for rolling on the lower flange of the corresponding longitudinal guide members 6, 6' of the towers 2, 2'. The ends of the cross-members 24 are also provided with bearings 26' of vertical axis which act against the vertical web of the longitudinal members 6, 6' to laterally guide the tray 18.

Each runway 20 comprises a pair of small double-slope ramps 28 spaced apart by a distance just greater than the maximum wheel base scheduled for the vehicles 14, to ensure that all vehicles when parked have their wheels resting on the runways 20 internal to the ramps 28, which in this manner form a stop for the vehicle even if this is not in a braked state.

The two ramps 28 are fixed to the floor of the respective runway 20, but in one embodiment not shown on the drawings they can be longitudinally adjustable relative to the runway so that they can be adapted to the wheel base of vehicles of particular dimensions.

The ramps 28 can be made adjustable mechanically by known systems controlled preferably by a reader which reads the outline of the vehicle 14 and then adjusts their position so that said vehicle does not project beyond the tray 18.

In a position centrally below the plate 22 connecting the two runways 20 together there are provided two parallel appendices 30 welded to the plate and facing downwards. These two appendices have parallel vertical surfaces, each comprising a hole 32 coaxial with the hole in the other. Their inner surface, ie that surface facing the other appendix, has bevelled vertical edges.

The two internal longitudinal guide members 6' of each cell 16 are connected together at their centre by a cross-member 34, to the central portion of which, by means of a bracket 36, there is fixed a member 38 for retaining the corresponding tray 18. This retention member 38 consists of a cylinder arranged parallel to the support cross-member 34 and houses internally two pins 40 kept projecting from the two opposing cylinder ends by the effect of a coil spring 42 interposed between them. The two pins 40 are each provided, within the cylindrical chamber 38, with a rack appendix 44 engaging a single gear wheel 46 which ensures simultaneous opposite movement of the two pins for the reasons clarified hereinafter. The dimensions of the retention member 38 are such that when the two pins 40 are completely within the cylinder which contains them, the entire unit lies between the two appendices 30, whereas when the two pins project from the cylinder, they engage the two holes 32 in said appendices 30 when the tray 18 is centrally positioned on the longitudinal guide members 6, 6'.

A centering member consisting of a plate 48 comprising a flared hole 50 is welded to the lower flange of each internal longitudinal guide member 6' at that end pointing towards the facing tower.

As stated, another essential element of the present invention is the platform 12 for handling the vehicles 14. It is supported by a vertical structure 52 arranged between two towers 2,2' and movable along the space defined by these.

More particularly, the vertical structure 52 comprises two vertical uprights 54 provided at their upper end with a suspension carriage 55 slidable along a longitudinal guide rail 56 supported by beams 57 which connect the two towers together and support a roof if provided. Lowerly, on the floor of the corridor defined by the two towers 2,2', there is provided a lower guide rail 59 with which a rack 60 is associated, engaged by a gear wheel 61 connected to the shaft of an electric motor 62, for moving the vertical structure 52 along the rail 56, 59.

Along the two vertical uprights 54, of the same height as the two towers 2,2' there slides via its two ends a beam to which there are fixed four longitudinal members 64,64' identical in shape, dimensions and arrangement to the four longitudinal guide members 6, 6' of each cell 16.

With each upright 54 of the vertical structure 52 there is also associated a hydraulic cylinder-piston unit 66, the rod 68 of which extends upperly and is provided at its end with a sprocket 70 about which a chain 72 passes. This chain is fixed at one end to the relative upright 54 and at its other end to the beam 63, which is slidable along the uprights 54 such that each synchronized elongation of the two cylinder-piston units through a certain distance causes said beam 63 to travel vertically through twice that distance.

Two double-acting cylinder-piston units 74, 74' are associated with the two internal longitudinal guide members 64' supported by the beam 63. Each cylinder-piston unit 74, 74' comprises a cylinder 76, 76' of length substantially equal to the length of the longitudinal members 64' a rod 78, 78' slidable along said cylinder 76, 76' and an outer jacket 80, 80' which completely encloses the cylinder longitudinally and almost completely circumferentially, with the exception of a thin longitudinal slit for the passage of brackets 81 for fixing the cylinder 76 to the longitudinal member 64', and two connectors for the entry and exit of the operating fluid. That end of the rod 78, 78' emerging from the respective cylinder 76, 76' is fixed to an endpiece 82 connected to the outer jacket 80, 80', the two cylinder-piston units 74, 74' being positioned in opposite directions so that the elongation of the respective rods 78, 78' takes place in opposite directions.

Carriages 84 provided with bearings for their support and guide along the upper flange of the relative longitudinal member 64' are fixed at several longitudinally spaced-apart points on the outer jacket 80, 80' of each cylinder-piston unit 74, 74', the purpose of which is to support the rod 78, 78' when extracted from the cylinder 76, 76' and to maintain it with its axis substantially rectilinear notwithstanding its considerable length. A small cylinder-piston unit 86, 86' is fixed to the same outer jacket 80, 80' trasversely, ie with its axis perpendicular to the axis of the longitudinal cylinder-piston units 74, 74'.

The diameter of the rod 88, 88' of these transverse cylinder-piston units 86, 86' is such that when their rod 88 is in the projecting state it can engage the corresponding appendix 30 of a tray 18 from the outside.

At both ends of each internal longitudinal guide member 64' there is provided a further cylinder-piston unit 90, the rod 92 of which has a diameter such as to engage in the hole 50 provided in the centering plate 48, to provide, as described hereinafter, perfect alignment of the longitudinal members 64, 64' with the longitudinal members 6, 6' of the cell 16, at which the platform 12 is to be positioned.

The installation according to the invention also comprises a plurality of controls, limit switches and automatic devices of various kinds for correct execution of the operating cycle. All these members, which are preferably controlled by a microprocessor, are of conventional type and require no further explanation.

To better understand the operation of the installation according to the invention, reference will be made to a situation, considered as the initial situation, in which some cells 16 house a motor vehicle 14 positioned on the respective tray 18 and other cells 16 are empty, ie housing a tray without a vehicle. The total number of platforms is N-2 where N is the number of cells 16, and each tray 18, with or without a vehicle 14, is supported on the two runways 20 by the cross-members 24 which rest on the longitudinal members 6, 6' and is securely connected to the respective cell by the engagement between the two pins 40 of the retention member 38 and the two appendices 30 of the tray 18.

The control computer knows both the extent of occupation of the various cells 16, ie whether each individual cell is free or occupied, and the position of the platform 12 which handles the vehicles 14, and which can for example be in front of the entry position 16' ie between the entry position 16' and the exit position 16''. For further clarity it should also be noted that an empty tray 18 is already positioned in the entry cell 16' and that one parking cell, which in FIG. 1 contains a vehicle 14 shown by dashed lines, and the exit cell, are both without trays 18.

If under these conditions a vehicle 14 arrives in front of the barrier giving access to the entry position 16' a conventional automatic dispencer dispenses a magnetic card carrying the arrival data and the data concerning that particular customer.

Extracting that card from the dispenser activates the barrier in conventional manner to free the passage for the vehicle 14 and enable it to rise, possibly via two ramps, into the entry cell 16'. At this point the vehicle 14 has its four wheels on the two runways 20, within the four small ramps 28 which as stated act as stop elements for the vehicle even if the driver has forgotten to apply the parking brake.

When the driver has left the vehicle he inserts the magnetic card into a reader, which reads the recorded data and transmits them to the control computer for their use, together with data which it already possesses, and in particular data regarding the position of the destination cell 16.

The transfer stage begins with a command for extending the rod 92 of all four centering cylinder-piston units 90 so that they engage in the hole 50 provided in the facing plates 48 rigid with the longitudinal guide members 6' of the entry cell 16' and exit cell 16'', to achieve perfect alignment between the four longitudinal members 64, 64' of the platform 12 and the four longitudinal members 6, 6' of said cells.

On termination of this operation oil is fed into the longitudinal cylinder-piston unit 74, from which the rod 78 and the relative jacket 80 are extended in the direction of the entry cell 16'.

The end-of-travel position of the cylinder-piston unit 74 corresponds to the positon in which the relative transverse cylinder-piston unit 86 is aligned with the retention member 38 for the tray 18 of the entry cell 16' ie to the position in which the transverse cylinder-piston unit 86 faces one of the two appendices 30 rigid with the tray. At this point a further automatic command causes the rod 88 of the transverse cylinder-piston unit 86 to extend and enter the hole 32 of said appendix 30 and push the facing pin 40 into the retention member 38. By virtue of the toothed coupling between the two pins 40 of the retention member, as one re-enters its cylindrical casing it causes the other to also simultaneously re-enter, with consequent disengagement of the two appendices 30. Hence in practice by operating the tower cylinder-piston unit 86 the retention of the tray 18 is transferred from the retention member 38, rigid with the entry cell 16' to the longitudinal cylinder-piston unit 74, rigid with the platform 12. Following a subsequent reverse command the cylinder-piston unit 74 pulls the rod 78 into the Cylinder 76 to hence transfer the tray 18, with the vehicle 14 standing on it, into the platform 12. This operation takes place by the rolling of the bearings. 26, 26' along the longitudinal members 6, 6' of the entry cell 16' and then along the longitudinal members 64, 64' of the movable platform. It should be noted that as soon as the tray 18 has begun to move towards the movable platform 12 and its appendices 30 have moved from the position facing the retention member 38, the elastic reaction of the spring 42 housed within this latter returns the two pins 40 to their outwardly projecting state.

When the platform 12 has reached that position in which it is supported only by the longitudinal members 64 64' the centering cylinder-piston units 90 are deactivated to completely release the platform from the two cells 16', 16'', and enable suitable commands, acting on the electric motor 62 for moving the vertical structure 52 and on the cylinder-piston units 66 for raising the platform 12 along the vertical structure 52, to move said platform 12 into a position facing the cell 16 not containing the tray 18, in accordance with the data available to the control computer.

On the drawings it is assumed that this cell 16 is situated in that tower 2' opposite the one containing the entry cell 16'. When the movable platform has reached the destination cell 16 and the electric motor 62 and cylinder-piston units 66 are at rest, a command is fed to the centering cylinder-piston units 90 to secure the platform 12 to the destination cell 16 and to the facing cell of the other tower 2, in order to achieve perfect alignment between the corresponding longitudinal members 64, 64' and 6, 6'.

When the rods 92 of the cylinder-piston units 90 have engaged the holes 50 of the two plates 48, a command is fed to the other longitudinal cylinder-piston unit 74' to transfer the tray 18 with the vehicle 14 into the destination cell 16.

During the final stage of this transfer travel, the two appendices 30 of the tray 18 interfere with the pins 40 elastically projecting from the retention member 38 of this destination cell, causing them to re-enter the cylindrical casing. Clearly on termination of this travel the two pins 40 remain in their re-entered state even though the holes 32 provided in the appendices face them, because one hole is occupied by the rod 88' of the transverse cylinder-piston unit 86'. When the rod 88' is made to re-enter, the two pins 40 of the retention member 38, which move simultaneously, can emerge elastically and securely lock the tray 18 to the destination cell 16.

The rod 78' of the longitudinal cylinder-piston unit 74' is then made to re-enter, followed by the rod 92 of the centering cylinder-piston units 90 in order to release the movable platform 12 from the cell which has just been filled.

At this point, in relation to the computer control program, different operations can be effected, all of which however enter within the scope of the present invention. For example, the movable platform 12 can withdraw an empty tray 18 from another cell 16 and transfer it to the entry position 16' for repeating the described cycle on arrival of another vehicle. Alternatively it can remain in that position to await a request, which can be either to locate another vehicle in another free cell or to withdraw a vehicle from an occupied cell on termination of its parking period. In this latter case, after verifying that the exit cell does not contain a tray 18, the described operating cycle is repeated in the reverse sequence. It is apparent that for correct location of a vehicle in a cell or withdrawal of a vehicle from a cell, the destination cell must be tray-free, the control program therefore including this verification before commencing transfer of the tray containing the vehicle.

As stated, a particular embodiment of the installation according to the invention has been described in which the movable platform is provided with two longitudinal cylinder-piston units 74, 74' each arranged to transfer the trays 18 from the platform to one of the two towers 2, 2' and vice versa. It is apparent that if the installation according to the invention comprises only one tower, a single cylinder-piston drive unit 74 is sufficient.

Figure 9:
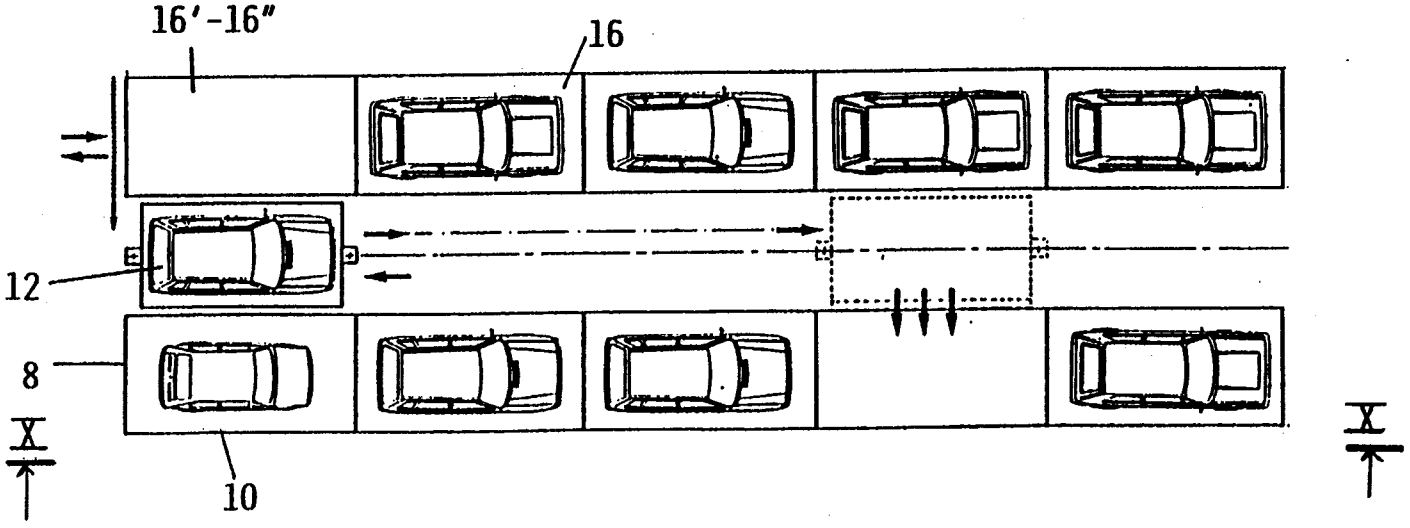
FIG. 9 is a plan view of a different configuration of the installation according to the invention.
Figure 10:
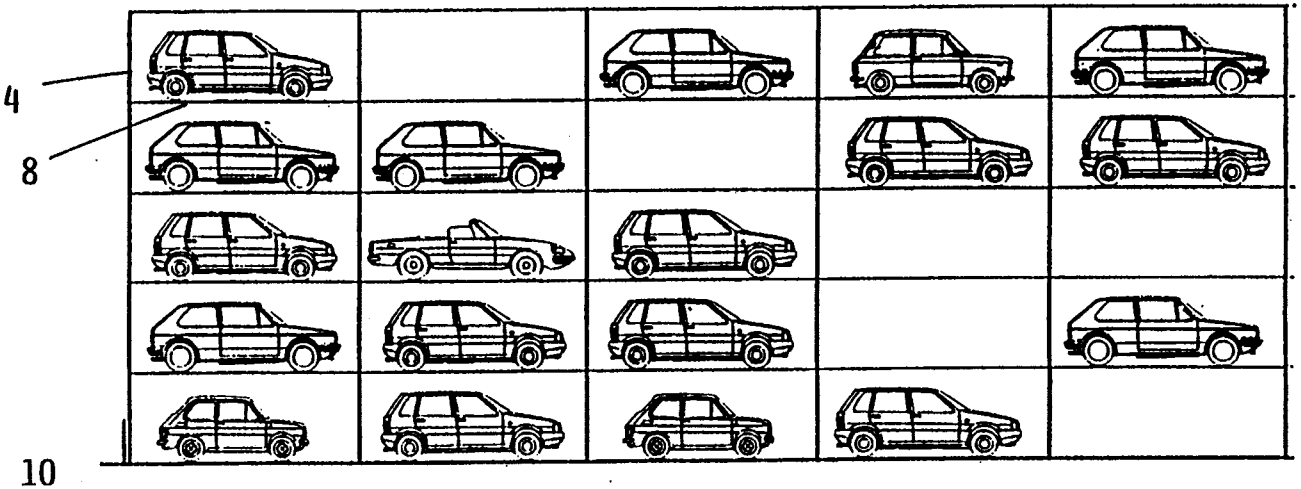
FIG. 10 is a front view thereof on the line X—X of FIG. 9.

FIGS. 9 to 14 schematically illustrate other embodiments of the invention. Specifically, FIGS. 9 and 10 show an installation having a configuration analogous to the preceding but with the entry position 16' coinciding with the exit position 16'' and with the vehicles 14 arranged aligned in the various cells 16.

Figure 12:
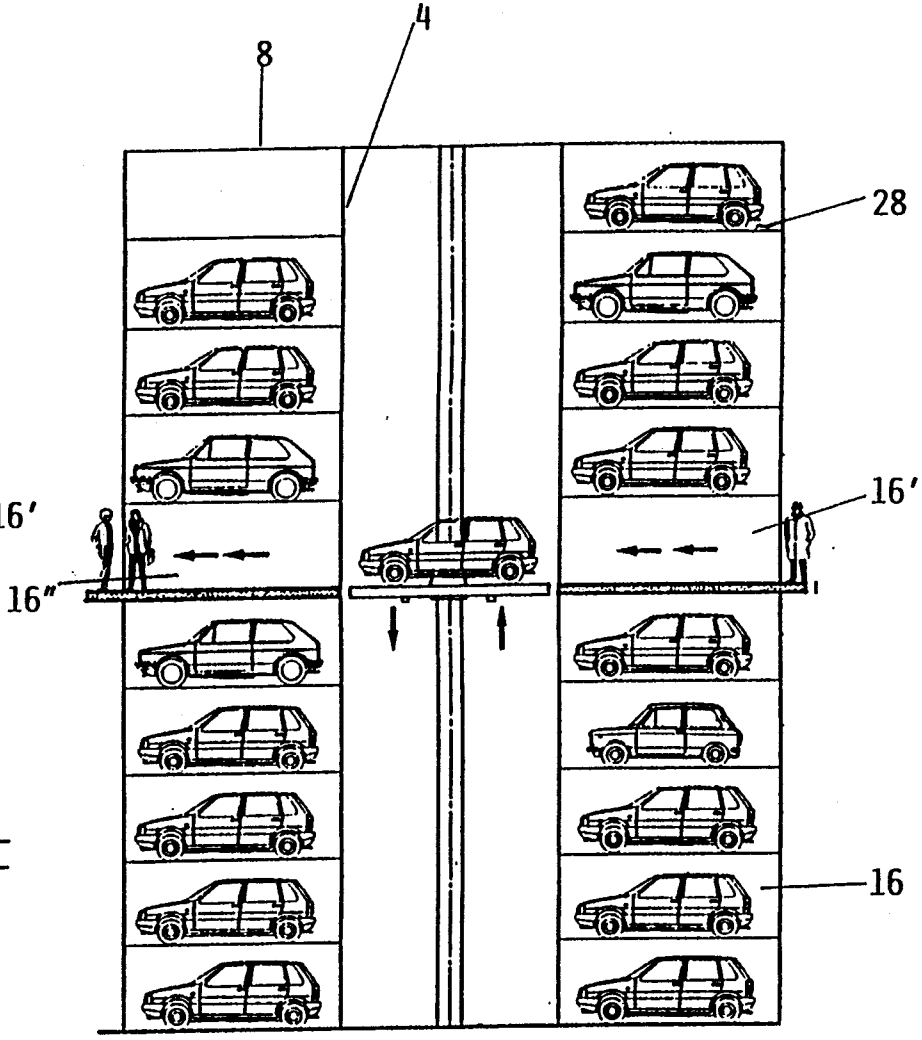
FIG. 12 is a side view thereof on the line XII—XII of FIG. 11.
Figure 11:
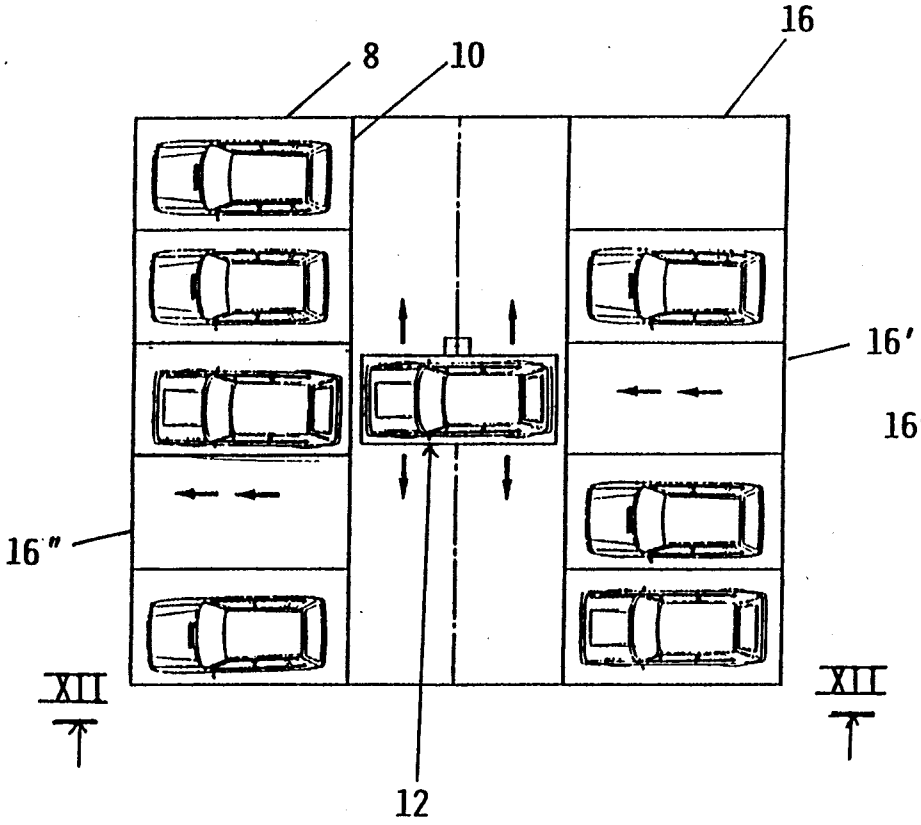
FIG. 11 is a plan view of a third configuration thereof.

FIGS. 11 and 12 show an installation with a configuration comprising two towers 2, 2' as in the case of FIG. 1, but lying partly underground and partly above ground. The entry position 16' and exit position 16'' are situated in the row at ground level, in an intermediate position but not aligned.

Figure 14:
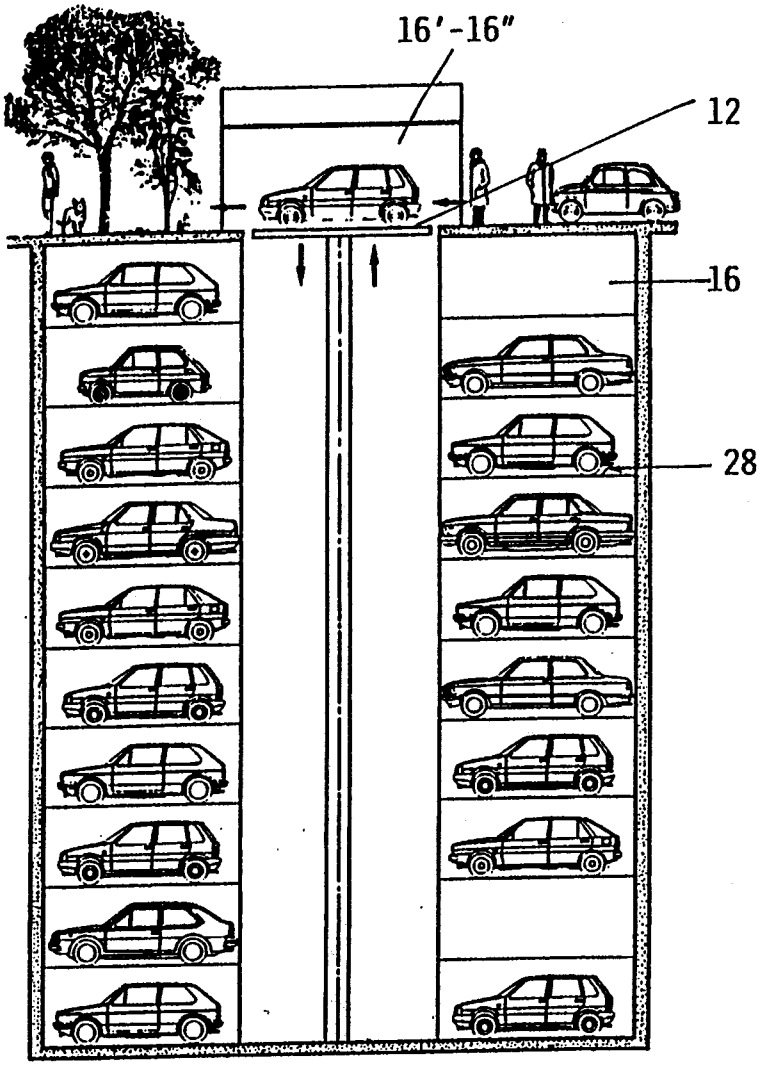
FIG. 14 is a side view thereof on the line XIV—XIV of FIG. 13.
Figure 13:
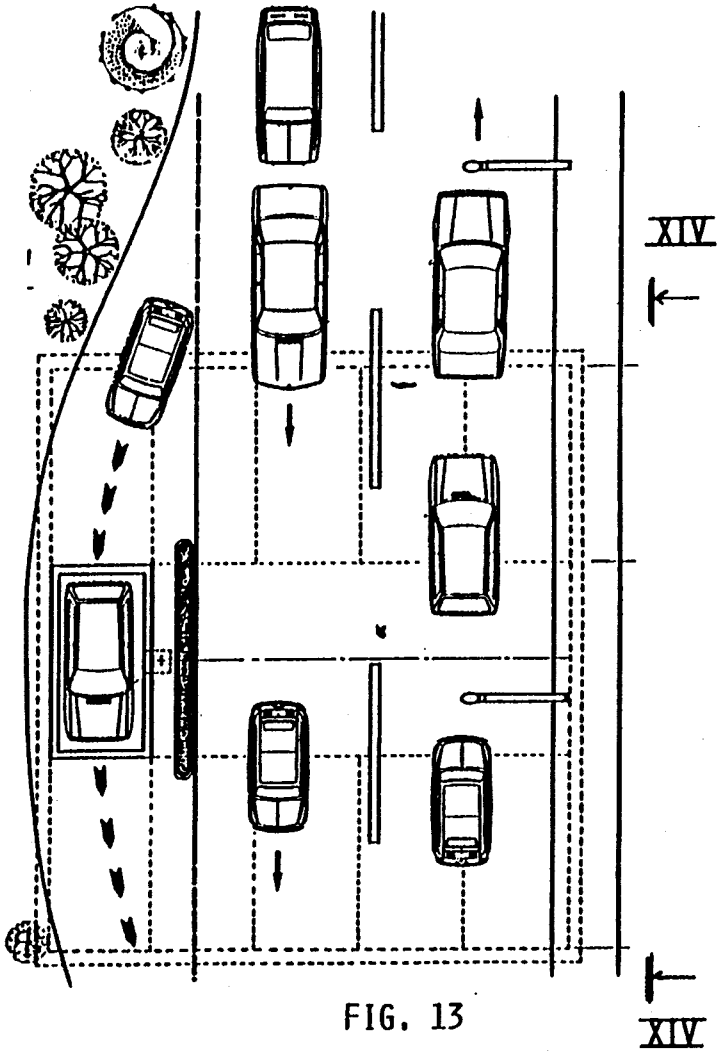
FIG. 13 is a plan view of a fourth configuration thereof.

Finally, FIGS. 13 and 14 show a configuration comprising two towers completely underground, the entry position coinciding with the exit position.

With regard to the various illustrated types, the invention is to be considered as covering all combinations obtained by combining the various characteristics.

From the aforegoing it is apparent that the installation according to the invention is particularly advantageous in that:

—it is free of limitations both in the choice of configuration and in its dimensions, and is therefore able to satisfy practically any requirement;

—it is of very simple construction and of very low cost per cell;

—it is extremely silent;

—it is of very reliable operation;

—it is suitable for virtually total automation;

—it can be used in the open or within a building, or partly in the open and partly within a building;

—it provides satisfactory protection of each vehicle against atmospheric agents by virtue of the tray of the overlying cell.

I claim:

1. A motor vehicle parking installation comprising:

—a load-bearing structure consisting of at least one tower (2, 2') comprising a plurality of cells (16, 16' 16'') arranged in superimposed horizontal rows, in each cell there being provided at least one pair of longitudinal horizontal guide members (6, 6') arranged perpendicular to said horizontal rows of cells;

—a platform (12) movable along a vertical structure (52), itself movable horizontally, parallel to said horizontal rows of cells, said platform (12) being provided with at least one pair of longitudinal members (64, 64') arranged in the same manner as the longitudinal members (6, 6') of each cell (16, 16' 16'');

—a plurality of trays (18), each comprising a pair of vehicle (14) parking runways (20);

—an actuator (74, 74') for moving the tray (18) between the platform (12) and the cells (16, 16' 16'') of each tower; and —means for connecting said actuator (74, 74') to each tray (18);

characterised in that

—each actuator (74,74') consists of a double-acting hydraulic cylinder-piston unit with axis parallel to said longitudinal guide members (6,6'), said unit having a first element (76,76') rigid with the platform (12) and a second element (78,78') movable relative to the first one and stretching towards said cells (16,16' 16''), —the means for connecting said actuator (74,74') to each tray (18) consists of a member (86,86' 30) integral with the movable part (78,78') of said cylinder-piston unit and activated only in its utmost elongated condition, —means (38,30) are provided for releasably connecting each tray (18) to the corresponding cell (16,16',16''), said means being disactivated by said member (86 86' 30) in its activated condition.

2. An installation as claimed in claim 1, characterised by comprising two towers (2, 2') facing each other in a mutually parallel manner and spaced apart by a distance suitable for the passage of the vertical structure (52) of said platform (12).

3. An installation as claimed in claim 2, characterised that the two towers (2, 2') are connected together by beams (57) supporting a rail (56) for suspending and guiding said vertical structure (52).

4. An installation as claimed in claim 3, characterised in that a lower guide rail (59) for said vertical structure (52) is arranged at floor level between the two towers (2, 2').

5. An installation as claimed in claim 2, characterised in that two guide rails for said vertical structure (52) are arranged at floor level between the two towers (2, 2').

6. An installation as claimed in claim 4 or 5, characterised in that with one lower rail (59) there is associated a rack (60) with which there is engaged a gear wheel (61) keyed onto the shaft of an electric motor (62) for horizontally moving said vertical structure (52).

7. An installation as claimed in claim 1, characterised in that the structure (52) comprises a pair of uprights (54), along which there slides the platform (12), which consists of a beam (63) to which the longitudinal members (64, 64') are fixed.

8. An installation as claimed in claim 7, characterised by comprising for each upright (54) a vertical cylinder-piston unit (66) for raising the beam (63).

9. An installation as claimed in claim 8, characterised in that each cylinder-piston unit (66) comprises a cylinder fixed to the relative upright (54) and a rod (68) emerging upperly from said cylinder and provided at its end with a sprocket (70) about which there passes a chain (72) fixed at one end to the upright and at its other end to said beam (63).

10. An installation as claimed in claim 1, characterised by comprising means (50, 92) for retaining the platform (12) in a position facing each cell (16, 16' 16'') with its longitudinal members (64, 64') aligned with the longitudinal members (6, 6') of this latter.

11. An installation as claimed in claim 10, characterised in that or at least one end of at least one longitudinal member (64, 64') of the platform (12) there is provided a cylinder-piston unit (90), the rod (92) of which can engage in a hole. (50) associated with the corresponding longitudinal member (6, 6') Of the various cells (16, 16' 16'') to ensure alignment between said longitudinal members (6, 6' 64 64').

12. An installation as claimed in claim 1, characterised in that the runways (20) of each tray (18) are provided lowerly with support cross-members (24) for wheels (26, 26') for the sliding of the tray along said longitudinal members (6, 6', 64, 64').

13. An installation as claimed in claim 1, characterised in that the two runways (20) of each tray. (18) are joined together by a connection plate (22).

14. An installation as claimed in claim 1, characterised in that to each runway (20) there are applied two double-inclination ramps (28) forming a stop for the vehicle positioned on the tray (18).

15. An installation as claimed in claim 14, characterised in that the two ramps (28) of each runway are adjustable along the runway (20).

16. An installation as claimed in claim 15, characterised in that each ramp (28) is associated with a mechanical actuator for its movement along the corresponding runway, said actuator being controlled by an outline reader positioned in correspondence with the ends of the tray (18) close to that ramp.

17. An installation as claimed in claim 1, characterised in that to that part of the cylinder-piston unit (74, 74') movable relative to the platform (12) there is applied a second cylinder-piston unit (86, 86') with its axis perpendicular to the axis of the cylinder-piston unit of the actuator (74, 74') and its rod (88, 88') movable between a position in which it engages a corresponding member (30) rigid with the tray (18) and a position in which it is disengaged from said member (30).

18. An installation as claimed in claim 5, characterised in that each cylinder-piston unit (74, 74') comprises a cylinder (76,76') rigid with the platform (12), a rod (78, 78') emerging from that end of said cylinder facing the tower (2, 2') relative to said cylinder-piston unit and a jacket (80) cicumferentially enclosing said cylinder with the exception of a longitudinal slit for the passage of the means (81) which connect this latter to the platform (12), and rigid with said rod (78, 78') at the free end of this latter, a second cylinder-piston unit (86, 86') being secured centrally to said jacket (80, 80').

19. An installation as claimed in claim 2 and 18, characterised in that the platform (12) is provided with two parallel cylinder-piston units (74, 74'), the rods of which emerge from the two opposing ends to operate on the two different towers (2, 2').

20. An installation as claimed in claim 1, characterised in that the means for releasably connecting each tray (18) to the corresponding cell (16, 16' 16'') consist of a cylinder (38) rigid with the cell structure and provided with at least one pin (40) movable axially between a position in which it is engaged with a corresponding member (30) rigid with the tray (18) and a position in which it is disengaged from said member.

21. An installation as claimed in claim 20, characterised in that the cylinder (38) is provided with a pair of pins (40) emerging from its two ends.

22. An installation as claimed in claim 21, characterised in that means (44,46) are associated with the two pins (40) for their opposing movement.

23. An installation as claimed in claim 22, characterised in that the two pins (40) are provided inside the cylinder (33) with a rack appendix (44) engaged with a single gear wheel (46) also housed within said cylinder (38), a spring (42)being interposed between the two pins (40) to maintain them elastically in their projecting position.

24. An installation as claimed in claim 17, characterised in that said member comprises two parallel appendices (30) affixed to each tray (18) and projecting vertically downward and comprising two coaxial holes (32), which can be engaged by two pins (40) of a retention member (38) between said appendices when the tray (18) is correctly positioned on a cell (16, 16' 16''), and can also be engaged on the opposite side by the rod (88, 88') of the two second cylinder-piston units (86, 86').

25. An installation as claimed in claim 24, characterised in that two inner walls of the two appendices (30) have bevelled vertical edges.

* * * * *